US008393676B2

(12) United States Patent
Hill

(10) Patent No.: US 8,393,676 B2
(45) **Date of Patent: *Mar. 12, 2013**

(54) DECORATIVE BENCH OR SEAT ASSEMBLY HAVING A PHOTOLUMINESCENT WORK BONDED THERETO

(76) Inventor: Dennis Michael Hill, St. Clair, MI (US)

( * ) Notice: Subject to any disclaimer, the term of this patent is extended or adjusted under 35 U.S.C. 154(b) by 315 days.

This patent is subject to a terminal disclaimer.

(21) Appl. No.: 12/765,087

(22) Filed: Apr. 22, 2010

(65) Prior Publication Data

US 2011/0095579 A1 Apr. 28, 2011

Related U.S. Application Data

(63) Continuation-in-part of application No. 12/606,692, filed on Oct. 27, 2009.

(51) Int. Cl.
*A47C 15/00* (2006.01)

(52) U.S. Cl. ..... 297/232; 297/440.13

(58) Field of Classification Search ..... 297/232, 297/440.13, 440.15; 40/542
See application file for complete search history.

(56) References Cited

U.S. PATENT DOCUMENTS

| | | | | |
|---|---|---|---|---|
| 604,658 | A | 5/1898 | Forster | |
| 948,770 | A | 2/1910 | Price | |
| 1,078,810 | A | 11/1913 | Van Derveer | |
| 1,626,095 | A * | 4/1927 | Ramsburg | 47/18 |
| 1,756,351 | A | 4/1930 | Gentile | |
| 1,862,382 | A | 6/1932 | Mathis | |
| 1,886,988 | A | 11/1932 | Thelen | |
| 2,659,422 | A | 11/1953 | Holland | |
| 3,517,937 | A * | 6/1970 | Disko et al. | 273/157 A |
| 3,547,491 | A * | 12/1970 | Bovasso | 297/440.13 |
| 3,591,942 | A * | 7/1971 | Van Swearingen | 40/615 |
| 3,603,656 | A * | 9/1971 | Ferman | 312/195 |
| 3,756,657 | A | 9/1973 | Johnson | |
| 4,055,014 | A * | 10/1977 | Schmidt et al. | 40/442 |
| 4,593,950 | A * | 6/1986 | Infanti | 297/3 |
| 4,600,251 | A | 7/1986 | Zimmerman | |
| 4,715,137 | A * | 12/1987 | Scheve | 40/546 |
| 4,828,531 | A * | 5/1989 | Kuhn | 446/392 |
| 5,329,716 | A * | 7/1994 | Fite | 40/575 |
| 5,557,869 | A * | 9/1996 | Douglas | 40/542 |
| 5,585,160 | A * | 12/1996 | Osthassel | 428/66.5 |

(Continued)

FOREIGN PATENT DOCUMENTS

| | | | |
|---|---|---|---|
| DE | 2007006449 | * | 9/2007 |
| WO | WO 9301581 A1 | * | 1/1993 |

OTHER PUBLICATIONS

Reckli GmbH- "Photo-Engraving Formliners" download, website: http://www.reckli.net/foto-gravur-matrizen.html?&L=5; dated Jan. 2009.

*Primary Examiner* — David Dunn
*Assistant Examiner* — David E Allred
(74) *Attorney, Agent, or Firm* — Brooks Kushman P.C.

(57) ABSTRACT

A bench or seat assembly including a decorative work bonded thereto in an essentially permanent fashion is provided wherein the work includes a photoluminescent material. The assembly includes a masonry seat member having an upper surface, a masonry back member having front and back surfaces and a support having exterior surfaces for supporting the seat member at a desired height. The work may include advertising or an image of which the photoluminescent material is a part of. The photoluminescent material may be photoluminescent particulate pigment or at least one photoluminescent stone which gives off light sufficient to allow at least a portion of the work to be viewed under limited ambient light conditions. In this way, the assembly is decorative not only in the daytime but also at night. The assembly may be an interlocking precast slab bench or seat assembly.

20 Claims, 3 Drawing Sheets

U.S. PATENT DOCUMENTS 5,765,922 A * 6/1998 Hsia ..... 297/440.1
6,036,326 A * 3/2000 Yoshikawa et al. ..... 362/23
6,090,324 A 7/2000 Keady
6,413,007 B1 7/2002 Lambright
6,499,421 B1 * 12/2002 Honigsbaum ..... 116/205
6,644,750 B1 * 11/2003 Sandman et al. ..... 297/440.21
6,665,986 B1 * 12/2003 Kaplan ..... 52/102
D484,714 S 1/2004 Que
6,887,010 B2 5/2005 Mayer Rodis
7,412,790 B2 * 8/2008 Riopel et al. ..... 40/546
7,600,335 B2 * 10/2009 Suprina ..... 40/320
2003/0107255 A1 * 6/2003 Willy ..... 297/440.13
2005/0064936 A1 * 3/2005 Pryor ..... 463/36
2005/0161985 A1 7/2005 Austin
2005/0198879 A1 * 9/2005 Hannington ..... 40/570
2007/0001124 A1 * 1/2007 Moreno Sobrino et al. ..... 250/484.4
2008/0132332 A1 * 6/2008 Pryor ..... 463/31
2008/0217584 A1 * 9/2008 Sturley ..... 252/301.36
2008/0309134 A1 * 12/2008 Brandtner ..... 297/232
2010/0251649 A1 * 10/2010 Woolbright ..... 52/309.17

* cited by examiner

DECORATIVE BENCH OR SEAT ASSEMBLY HAVING A PHOTOLUMINESCENT WORK BONDED THERETO

CROSS-REFERENCE TO RELATED APPLICATIONS

This application is a continuation-in-part of U.S. application Ser. No. 12/606,692 filed Oct. 27, 2009 entitled "Interlocking Precast Slab Assembly Such As A Bench Or A Memorial Marker."

BACKGROUND OF THE INVENTION

1. Field of the Invention

This invention relates to decorative bench or seat assemblies made of masonry such as precast slabs.

2. Background Art

Precast concrete is concrete in the form of blocks, pillars, bridge sections and the like that have been cast into forms before being put into position. Such concrete can be assembled into a variety of structures such as benches. For example:

U.S. Pat. No. 2,659,422 discloses a concrete bench, including advertising space on the back thereof;

U.S. Pat. No. 3,756,657 discloses a concrete bench per se;

U.S. Pat. No. 1,862,382 discloses a concrete bench formed in a number of sections, wherein the back section is cast as a single long slab;

U.S. Pat. No. 1,886,988 discloses a bench constructed of cement for outdoor use which is cast in two sections—a leg section or base and a seat section;

U.S. Pat. No. 1,626,095 discloses a florist bench made of concrete and which is formed of sections;

U.S. Pat. No. 948,770 discloses a seat constructed of cement;

U.S. Design Pat. No. D484,714 discloses a concrete and steel bench;

U.S. Pat. No. 6,887,010 disclose a decorative bench;

U.S. Pat. No. 6,090,324 discloses a forming system for stone or concrete benches; and U.S. Published Patent Application No. 2005/0161985 discloses a stone or masonry bench having upright supports, a bottom seat and an optional upright back support.

The following U.S. patent documents are also related: U.S. Pat. Nos. 1,756,351; 604,658; 6,413,007; 4,600,251 and 1,078,810.

Decorative concrete or grout panels or slabs can be formed from photo-engraved formliners. These formliners can be cut by CNC machines, the input of which is a digital photograph. Such concrete panels can be used as decorative pieces either standing alone or as part of a larger wall structure.

Phosphorescent pigments are those in which excitation by a particular wavelength of visible or ultraviolet radiation results in the emission of light lasting beyond the excitation. After cessation of luminescence and renewed exposure to light, the material again absorbs light energy and exhibits a glow-in-the-dark property (an absorbing-accumulating-emitting cycle). Some phosphorescent pigments suffer from the problems of low luminescence and/or short afterglow.

One class of long-life phosphorescent pigments is the metal aluminates, particularly the alkaline earth aluminate oxides, of formula $MAl_2O_4$ where M is a metal or mixture of metals. Examples are strontium aluminum oxide ($SrAl_2O_4$), calcium aluminum oxide ($CaAl_2O_4$), barium aluminum oxide ($BaAl_2O_4$) and mixtures. These aluminate phosphors, with or without added magnesium, may be further activated with other metals and rare earths. Alkaline earth metal aluminate oxide phosphors and their preparation are discussed in U.S. Pat. No. 5,424,006 to Murayama et al.

Phosphorescent materials have found use in a variety of commercial applications including warning signs, machinery marking, dial illumination, directional signs, marking the edge of steps, fire helmets, accident prevention, protective clothing, sports equipment, etc.

The following U.S. patent documents describe a wide variety of commercial applications of such materials: 2007/0209747; 2005/0160637; 2009/0262514; 2007/0248836; U.S. Pat. Nos. 6,136,226; 5,811,174; 6,828,043; 6,665,986; 6,599,444; 5,904,017; and 5,961,072.

The following U.S. patent documents are also relevant: 2004/0197548; 2006/0162620; U.S. Pat. Nos. 5,376,303; 5,472,737; 6,005,024; 5,976,411; 6,074,739; 6,177,029; 6,375,864; and 6,444,077.

SUMMARY OF THE INVENTION

An object of the present invention is to provide an improved bench or seat assembly having a photoluminescent work bonded thereto to make the assembly decorative both in the daytime and also at night.

In carrying out the above object and other objects of the present invention, a decorative bench or seat assembly is provided. The assembly includes a masonry seat member having an upper surface, a masonry back member having front and back surfaces, a support having exterior surfaces for supporting the seat member at a desired height and a decorative work bonded to one of the surfaces in an essentially permanent fashion. The work includes a photoluminescent material which gives off light sufficient to allow at least a portion of the work to be viewed under limited ambient lighting conditions.

The material may include photoluminescent particulate pigment. The work may include a photoluminescent pigment layer comprising a first binder with the photoluminescent particulate pigments essentially uniformly dispersed in the binder.

The work may further include an optically transmissive clear coat layer in overlying relationship with the pigment layer.

The work may include advertising.

The work may include an image.

The photoluminescent material may include at least one photoluminescent stone bonded to the one of the surfaces. The at least one stone may form at least a part of the image.

The work may include a colored pigment layer in side-by-side relationship with the photoluminescent pigment layer. The colored pigment layer may include a second binder and colored particulate pigments dispersed in the second binder.

The colored pigment layer may include a first set of indicia which conveys information during the day and the photoluminescent pigment layer may include a second set of indicia which conveys substantially the same information at night as the information conveyed by the first set of indicia during the day.

Both the first binder and the clear coat layer may include an acrylic-based clear sealer.

Each of the members may be a precast concrete slab.

The image may have at least one eye and the at least one stone may form the at least one eye.

The seat member may have an elongated groove formed in a lower surface of the seat member and the support may have an upper edge portion which fits into the elongated groove formed in the lower surface to form a joint which interlocks the seat member and the support together.

The seat member may have a pair of spaced elongated grooves formed in its lower surface and the support may have a pair of spaced upper edge portions which fit into the respective elongated grooves formed in the lower surface to form a pair of spaced joints which interlock the seat member and the support together.

The seat member may have an inner support surface on which the back member is supported and at least one hole which extends between and fluidly communicates the inner support surface and the bottom surface of the seat member.

The assembly may further include concrete or grout to rigidly lock the members together.

Further in carrying out the above object and other objects of the present invention, a decorative interlocking precast slab bench or seat assembly is provided. The assembly includes a precast seat member having an upper exterior surface, a lower surface, an elongated groove formed in the upper exterior surface and a pair of spaced elongated grooves formed in the lower surface. The assembly further includes a precast back member having front and back exterior surfaces and an elongated edge portion which fits into the elongated groove formed in the upper exterior surface to form a joint which interlocks the members together. The assembly still further includes a support having exterior surfaces and including a pair of spaced precast support members for supporting the seat member at a desired height. Each of the support members has an upper edge portion which fits into its respective elongated groove formed in the lower surface of the seat member to form respective joints which interlock the seat member and the support members together. The seat member has an inner support surface on which the back member is supported within the groove in the upper exterior surface. The groove in the upper exterior surface is in fluid communication with the spaced elongated grooves formed in the lower surface to prevent the accumulation of liquid within the groove in the upper exterior surface. The assembly further includes a decorative work bonded to one of the exterior surfaces in an essentially permanent fashion. The work includes a photoluminescent material which gives off light sufficient to allow at least a portion of the work to be viewed under limited ambient lighting conditions.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
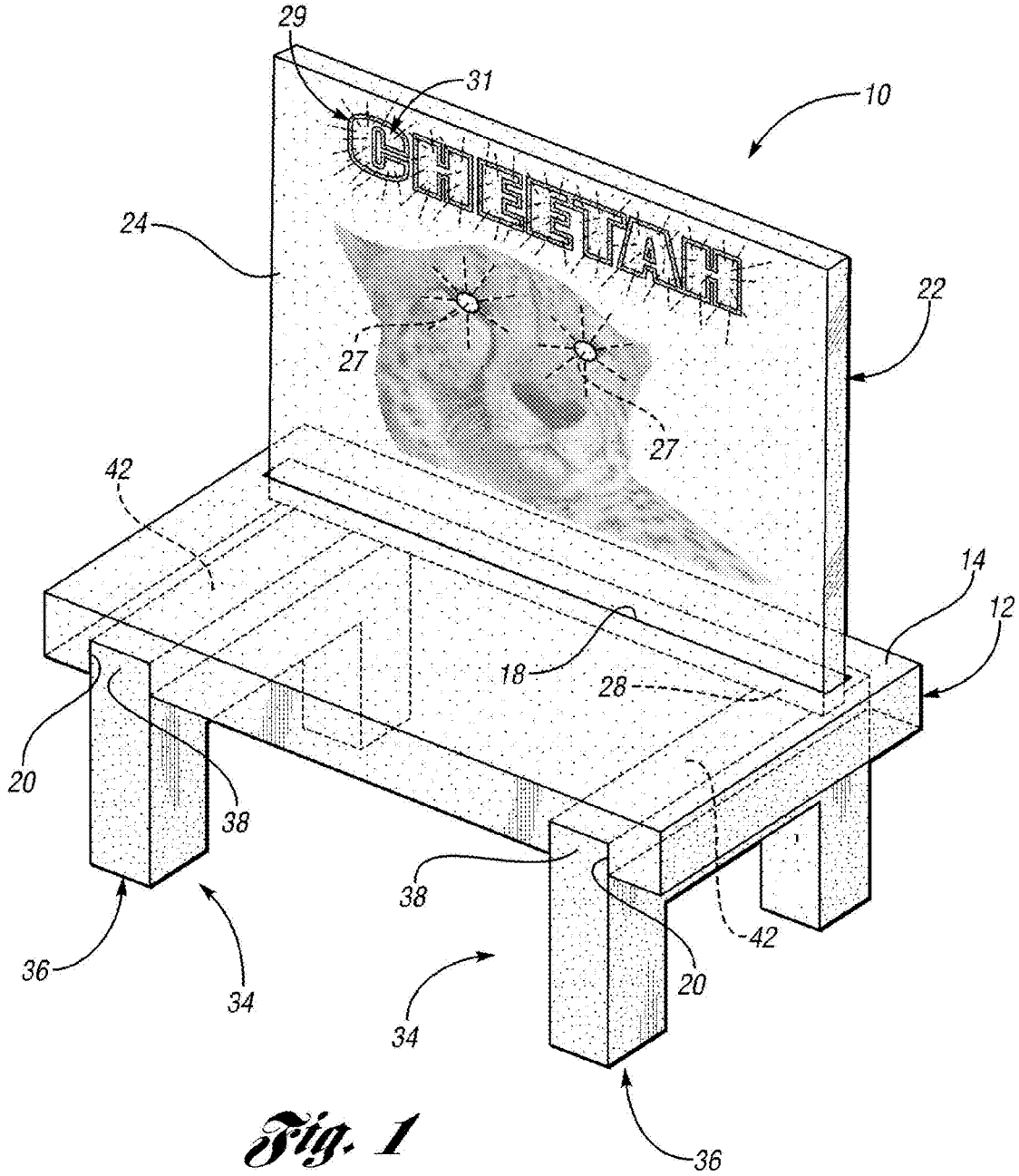
FIG. 1 is a perspective view of an interlocking precast slab bench or seat assembly constructed in accordance with at least one embodiment of the present invention wherein a decorative work (both a cheetah design and the lettering "cheetah") includes two types of photoluminescent material bonded to one of the exterior surfaces of the bench, thereby making the bench decorative not only during the day but also at night.
Figure 2:
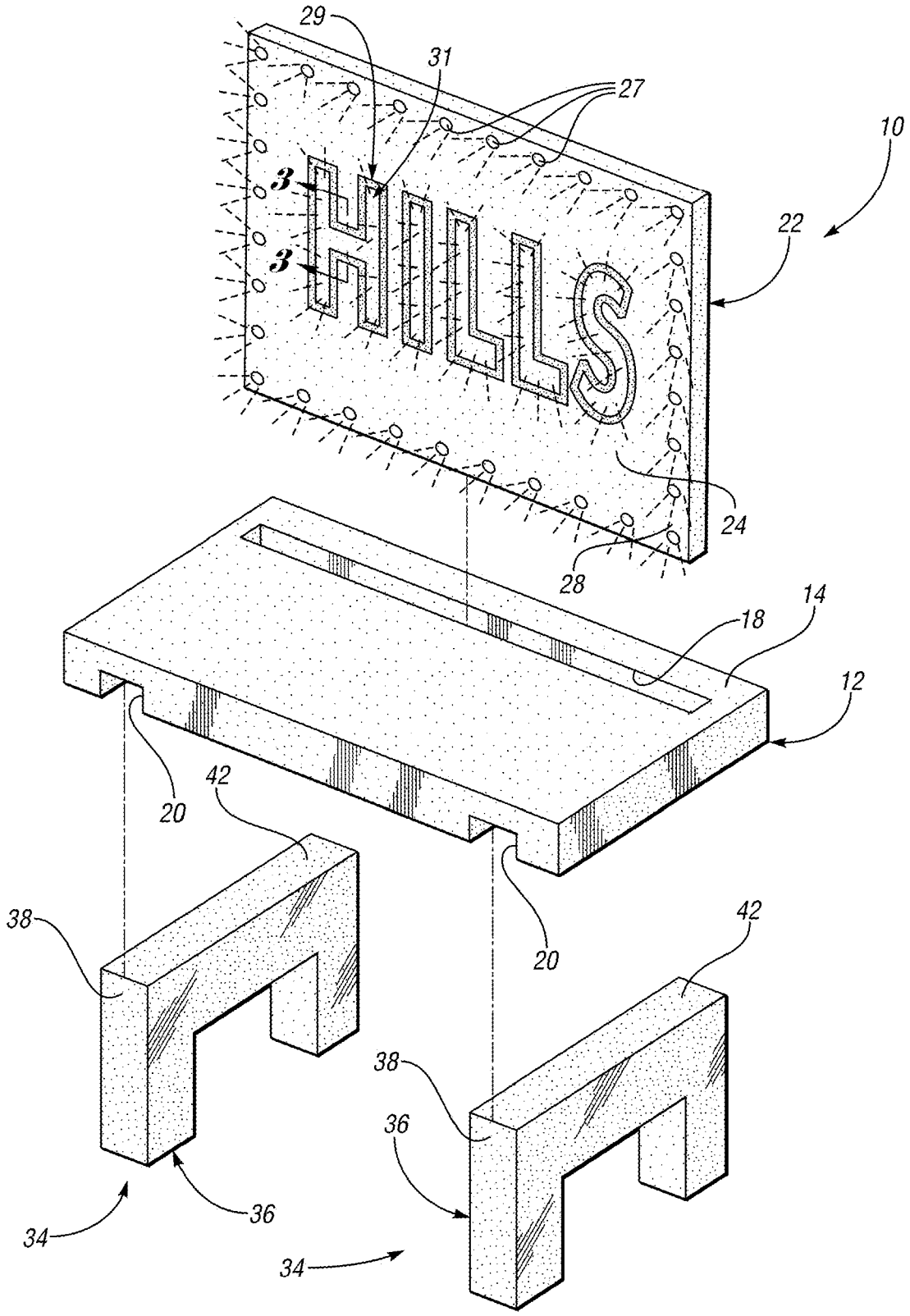
FIG. 2 is an exploded perspective view of the embodiment of FIG. 1 with a different decorative work in the form of advertising and lighting bonded to the front surface of a masonry back member of the assembly.
Figure 4:
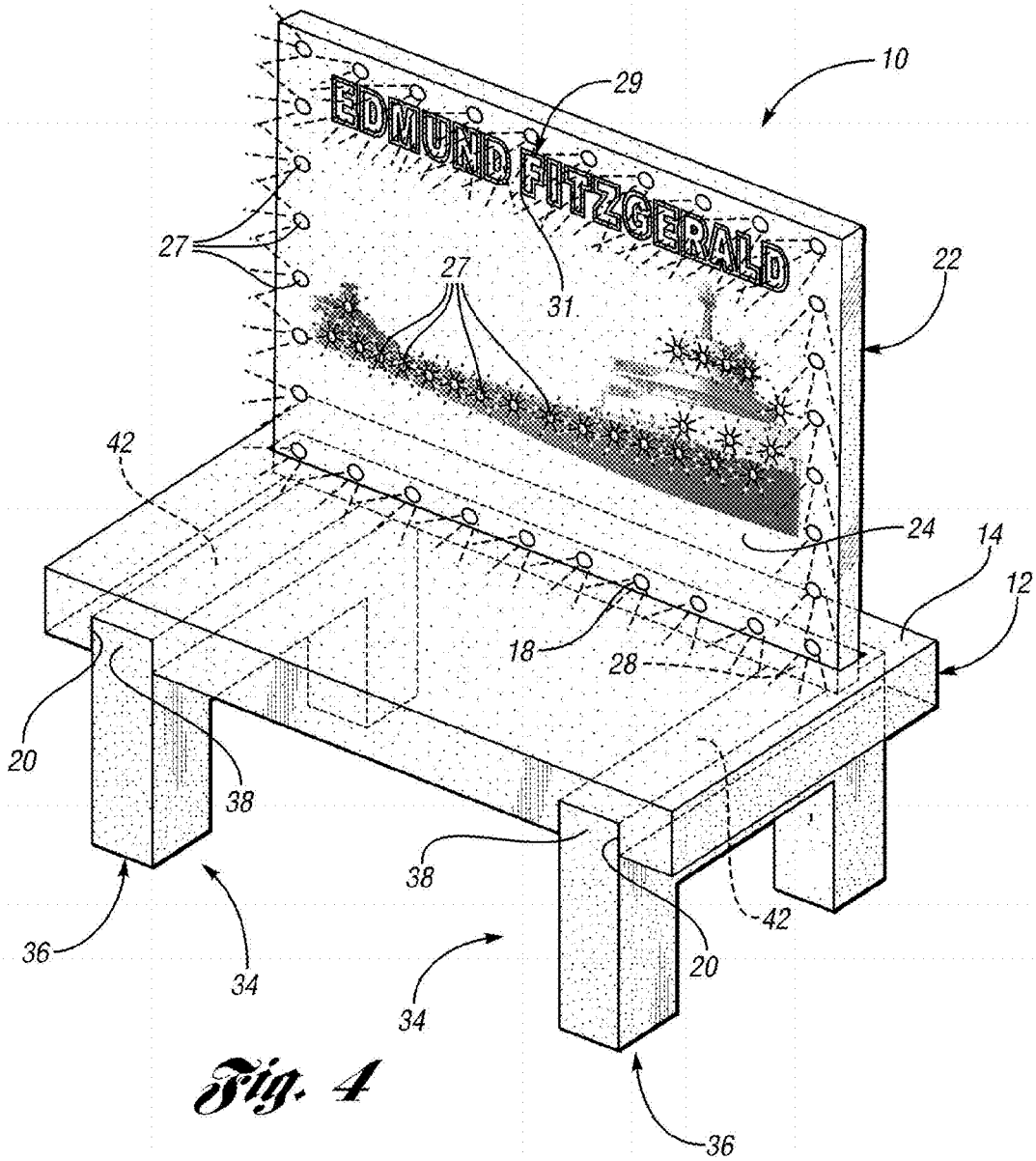
FIG. 4 is a view, similar to the view of FIG. 1, but showing a different decorative work (i.e. the Edmund Fitzgerald—both the design and the lettering) bonded to the front surface of the back masonry member.

Referring to the FIGS. 1, 2 and 4, there is illustrated a decorative masonry bench or seat assembly in the form of an interlocking precast slab assembly, generally indicated at 10. The bench 10 includes a masonry seat member such as a precast concrete seat member, generally indicated at 12, having an upper surface 14 and a lower surface. An elongated groove 18 is formed in the upper surface 14 and a pair of spaced elongated grooves 20 are formed in the lower surface.

The bench 10 also includes a masonry back member such as a precast grout back member, generally indicated at 22, having a front porous surface 24 to which is bonded a decorative work such as an image of an animal such as a cheetah, as well as two sets of indicia 29 and 31 which spell out the word "cheetah." One set of indicia 31 is bounded by and formed within a second set of indicia 29 in side-by-side relationship.

Figure 3:
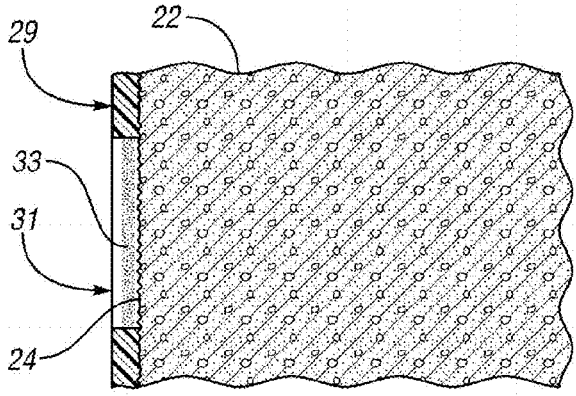
FIG. 3 is a view, partially broken away and in cross-section, of a portion of a stenciled letter (the generally horizontal portion of the letter 'H") of the embodiment of FIG. 2, taken along lines 3-3 with a photoluminescent pigment layer therebetween.

The eyes of the cheetah take the form of photoluminescent stones 27. The first set of outer indicia 29 or lettering includes a first outer border region of a colored concrete or masonry coating (including achromatic colors such as white, black and grey) and the second set of inner indicia 31 of photoluminescent particulate pigment or sand 33 (FIG. 3) essentially uniformly dispersed in a binder layer of a clear acrylic-based sealer. The colored concrete coating may be a modified acrylic polymer resin with a colorant specifically designed for concrete surfaces. In turn, the binder layer is covered by a clear coat layer. Consequently, the word "cheetah" is visible not only in the day but also during limited ambient lighting conditions such as during the night.

A particularly useful location for the bench of FIG. 1 would be at a zoo in front of locations having one or more cheetahs.

The back member 22 also has an elongated lower edge portion 28 which fits into the elongated groove 18 formed in the upper surface 14 to form a joint which interlocks the members 12 and 22 together with the decorated front surface 24 supported above the upper surface 14 of the seat member 12 for viewing. It is to be understood that a decorative work could be bonded to the back surface of back member 22 or on the upper surface 14 of the seat member 12 in addition to or instead of the front surface 24 of the back member 22.

Preferably, the front and/or back surface 24 of the precast grout back member 22 (as well as the upper surface 14 of the seat assembly 12) has a decorative work such as advertising (FIG. 2) or an image (FIGS. 1 and 4) bonded thereto. The decorative work includes a photoluminescent material such as stone (FIGS. 1, 2 and 4) and/or sand (i.e. dust-like particles or particulate pigment of FIGS. 1, 2 and 4) which gives off light sufficient to allow at least a portion of the work to be viewed under limited ambient light conditions such as dawn, dusk or at night.

In at least one embodiment, the decorative work is in the form of a custom art design which is digitally prepared on an appropriately programmed computer. Inputs to the computer may include a digital image or a photograph provided by a digital camera or other input device for inputting decorative works including lettering, numbers, advertising, logos, designs and the like. Such digital decorative works can also be downloaded over the Internet.

The computer may be programmed to manipulate, enhance and change the digital decorative work to obtain a desired work or work of art. The computer may be coupled to a flatbed router or cutter which cuts one or more sheets of material under computer control to form one or more stencils. One side of the sheet of material may have an adhesive formed thereon.

The adhesive side of the cut stencil(s) is positioned on a clean, preferably porous surface of one of the members 12 and 22. Then a first liquid coating composition such as a colored concrete coating is applied through the openings in the stencil to form the first set of indicia 29 in the form of letters. The colored concrete coating typically has reflective or achromatic colored particles suspended in a binder or matrix. The same cut stencil or one or more different cut stencils may be used to form the cheetah image in FIG. 1. Then the one or more stencils are removed from the member 12 or 22.

Then a binder preferably in the form of an acrylic-based clear sealer is evenly applied to the clean, porous surface of the member 12 or 22 within the borders of the stenciled letters (i.e. the first set of indicia 29) spelling out the name "cheetah."The binder penetrates the porous surface to form a thin film layer on the surface. The binder or sealer may be Super Seal™ 2000 obtained from Concrete Coatings, Inc. of Utah. Then an essentially uniform coating of photoluminescent sand or particulate pigment such as strontium diluminate activated by Europium is evenly sprinkled or shaken over the film. Finally, a second layer of the sealer is evenly applied over the pigment layer. After curing, the resulting decorative work is bonded to the porous concrete surface in an essentially permanent fashion with the photoluminescent particulate pigment essentially uniformly dispersed in the binder and the optically transmissive clear coat layer in overlying relationship with the photoluminescent pigment layer.

In this way the front surface 24 of the back member 22 is formed with first and second sets of indicia 29 and 31, respectively, which convey information such as a name associated with the image bonded to the front surface 24 of the back member 22. One set of outer indicia 29 provided by a first colored coating composition (i.e. such as the colored concrete coating) is visible during the day and a second set of inner indicia provided by a second coating composition (including photoluminescent sand or particulate pigment) is visible through its emitted light under limited lighting conditions. It is to be understood that the color of the first colored coating composition may be an achromatic color such as black, white and grey.

FIG. 4 is similar to FIG. 1 except an image of the ship the "Edmund Fitzgerald" is formed on the front surface 24 of the back member 22. Photoluminescent stones 27 form the running lights as well as the port holes of the ship. Also, the photoluminescent stones 27 are bonded to the front surface 24 (typically while the concrete back member 22 is still wet or uncured) about the outer periphery of the front surface 24 to help illuminate the design under limited ambient lighting conditions such as at night. Such illuminating photoluminescent stones 27 are also provided in FIG. 2 to help illuminate the advertising lettering "Hills."

The bench 10 also includes a support, generally indicated at 34, including a pair of spaced, precast concrete support members, generally indicated at 36, for supporting the seat member at a desired height. Each of the support members 36 has an upper edge portion 38 which fits into its respective elongated groove 20 formed in the lower surface 16 of the seat member 12 to form respective joints which interlock the seat member 12 and the support members 36 together. Exterior surface(s) of the support 24 may have decorative works bonded thereto in the same fashion as the members 12 and 22 have decorative works bonded thereto.

The seat member 12 has an inner support surface on which the back member 22 is supported within the groove 18 in the upper surface 14. A top surface 42 of each of the support members 36 also provides support for the back member 22 at its lower surface 44. The groove 18 in the upper surface 14 is in fluid communication with the spaced elongated grooves 20 formed in the lower surface of the member 12 to prevent the accumulation of liquid within the groove 18 in the upper surface 14.

Both the photoluminescent sand or particulate pigment and stones are available from Ambient Glow Technology of Canada. The sand may be a photoluminescent particulate pigment such as strontium diluminate activated by Europium and having a formula $MO.aAl_2O_3.bS10_2.cL:fX$.

The binder or sealer for the photoluminescent material as well as the outer clear coat is available from Concrete Coatings, Inc. of Utah under the trade name Super Seal™ 2000.

The seat member 12 and each of the support members 36 may be made of Quik-Crete Pro-Finish 5,000 psi concrete mix with stealth fiber-mesh fibers for reinforcement.

The back member 22 may be made of grey non-shrink grout. No wire or fiber mesh is typically required.

In summary, the decorative bench or seat assembly 10 is an interlocking precast slab bench or seat assembly including a precast seat member 12 having upper and lower surfaces and an elongated groove formed in the upper surface of the seat member. The assembly further includes a precast grout back member 22 having a front surface on which is bonded a decorative three-dimensional work. The back member 22 has an elongated lower edge portion which fits into the elongated groove to form a joint which interlocks the members together to form the assembly with the decorative front surface supported above the upper surface of the seat member for viewing not only during the day but also during limited ambient lighting conditions such as at night. It is to be understood that not only can the front surface of the back member be so decorated but also the other exterior surfaces of the assembly can be so decorated with works including photoluminescent material such as particulate pigment or stones.

As defined herein, the term "clear" as used with the clear coat layer is defined as a material that can be seen through. The term "optically transmissive" as used herein is taken to mean transmissive to desired wavelengths of electromagnetic radiation such as in visible light. Generally transmissivities greater than 50 percent of visible light are contemplated with high transmissivities of greater than 90 percent being useful. The polymeric material of choice employed in the clear coat layer can be one that imparts suitable scratch and abrasion resistance as desired or required. As such, it is contemplated that the clear coat layer can include suitable abrasion resistance enhancing additives as would be known to the skilled artisan. It is also contemplated that the clear coat layer can include additives which impart ultraviolet resistance and resistance to other undesirable environmental factors. Once again, such additives are typically known to the skilled artisan.

It is contemplated that dispersion of the photoluminescent particulate pigment material is essentially uniform throughout the photoluminescent particulate pigment layer. As used herein, the term "essentially uniform" is taken to mean a dispersion of the particulate pigment material in a manner that exhibits minimal perceptible clumping or agglomeration of the particulate pigment.

It is further contemplated that the decorative work is bonded to one of the exterior surfaces of the assembly in an essentially permanent fashion. As used herein, the term "essentially permanent" is taken to mean that the substrate and overlying film material are integrally connected to one another throughout the life of the associated part.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A decorative bench or seat assembly comprising:

a masonry seat member having an upper surface and a lower surface;

a masonry back member having front and back surfaces;

a support having exterior surfaces for supporting the seat member at a desired height; and a decorative work bonded to one of the surfaces in an essentially permanent fashion, the work including a photoluminescent material which gives off light sufficient to allow at least a portion of the work to be viewed under limited ambient lighting conditions;

wherein the seat member includes an elongated groove in the upper surface for supporting the back member and an elongated groove in the lower surface for receiving the support, and wherein the elongated grooves intersect to provide fluid communication between the grooves.

2. The assembly as claimed in claim 1, wherein the material includes photoluminescent particulate pigment and wherein the work includes a photoluminescent pigment layer comprising a first binder with the photoluminescent particulate pigment essentially uniformly dispersed in the binder.

3. The assembly as claimed in claim 2, wherein the work further includes an optically transmissive clear coat layer in overlying relationship with the pigment layer.

4. The assembly as claimed in claim 1, wherein the work includes advertising.

5. The assembly as claimed in claim 1, wherein the work includes an image.

6. The assembly as claimed in claim 5, wherein the photoluminescent material includes at least one photoluminescent stone bonded to the one of the surfaces and wherein the at least one stone forms at least a part of the image.

7. The assembly as claimed in claim 2, wherein the work includes a colored pigment layer in side-by-side relationship with the photoluminescent pigment layer, the colored pigment layer comprising a second binder and colored particulate pigments dispersed in the second binder.

8. The assembly as claimed in claim 7, wherein the colored pigment layer includes a first set of indicia which conveys information during the day and the photoluminescent pigment layer includes a second set of indicia which conveys substantially the same information at night as the information conveyed by the first set of indicia during the day.

9. The assembly as claimed in claim 3, wherein both the first binder and the clear coat layer include an acrylic-based clear sealer.

10. The assembly as claimed in claim 1, wherein each of the members is a precast concrete slab.

11. The assembly as claimed in claim 6, wherein the image has at least one eye and wherein the at least one stone forms the at least one eye.

12. The assembly as claimed in claim 1, wherein the support has an upper edge portion which fits into the elongated groove in the lower surface to form a joint which interlocks the seat member and the support together.

13. The assembly as claimed in claim 1, wherein the elongated groove in the lower surface is a first elongated groove and the seat member has a second elongated groove in the lower surface of the seat member spaced from the first elongated groove, and wherein the support has a pair of spaced upper edge portions which fit into the respective elongated grooves in the lower surface to form a pair of spaced joints which interlock the seat member and the support together.

14. The assembly as claimed in claim 1, wherein the seat member has at least one hole which extends between and fluidly communicates the grooves.

15. The assembly as claimed in claim 1, further comprising concrete or grout to rigidly lock the members together.

16. A decorative interlocking precast slab bench or seat assembly comprising:

a precast seat member having an upper exterior surface, a lower surface, an elongated groove formed in the upper exterior surface and a pair of spaced elongated grooves formed in the lower surface;

a precast back member having front and back exterior surfaces and an elongated edge portion which fits into the elongated groove formed in the upper exterior surface to form a joint which interlocks the members together;

a support having exterior surfaces and including a pair of spaced precast support members for supporting the seat member at a desired height, each of the support members having an upper edge portion which fits into its respective elongated groove formed in the lower surface of the seat member to form respective joints which interlock the seat member and the support members together, wherein the seat member has an inner support surface on which the back member is supported within the groove in the upper exterior surface and wherein the groove in the upper exterior surface intersects with the spaced elongated grooves formed in the lower surface to provide fluid communication between the groove in the upper exterior surface and the spaced elongated grooves and to inhibit the accumulation of liquid within the groove in the upper exterior surface; and a decorative work bonded to one of the exterior surfaces in an essentially permanent fashion, the work including a photoluminescent material which gives off light sufficient to allow at least a portion of the work to be viewed under limited ambient lighting conditions.

17. The assembly as claimed in claim 16, wherein the material includes photoluminescent particulate pigment and wherein the work includes a photoluminescent pigment layer comprising a first binder and the photoluminescent particulate pigment dispersed in the binder.

18. The assembly as claimed in claim 17, wherein the work further includes an optically transmissive clear coat layer in overlying relationship with the pigment layer.

19. The assembly as claimed in claim 17, wherein the work includes a colored pigment layer in side-by-side relationship with the photoluminescent pigment layer, the colored pigment layer comprising a second binder and colored particulate pigments dispersed in the second binder.

20. The assembly as claimed in claim 19, wherein the colored pigment layer includes a first set of indicia which conveys information during the day and the photoluminescent pigment layer includes a second set of indicia which conveys substantially the same information at night as the information conveyed by the first set of indicia during the day.

* * * * *